US007878019B2

(12) United States Patent
Cantolino

(10) Patent No.: US 7,878,019 B2
(45) Date of Patent: Feb. 1, 2011

(54) ONE-PIECE FLOAT SWITCH HOUSING AND DRAIN LINE ASSEMBLY WITH CONDENSATE COLLECTION PAN

(76) Inventor: Christopher Ralph Cantolino, 7704-18th Ave. NW., Bradenton, FL (US) 34209

( * ) Notice: Subject to any disclaimer, the term of this patent is extended or adjusted under 35 U.S.C. 154(b) by 1220 days.

(21) Appl. No.: 11/478,904

(22) Filed: Jun. 30, 2006

(65) Prior Publication Data

US 2008/0000250 A1 Jan. 3, 2008

(51) Int. Cl.
*F25D 21/14* (2006.01)

(52) U.S. Cl. ..... 62/285; 62/272

(58) Field of Classification Search ..... 62/272, 62/279, 285

See application file for complete search history.

(56) References Cited

U.S. PATENT DOCUMENTS 2,904,970 A * 9/1959 Fisher ..... 62/188
5,099,873 A * 3/1992 Sanchez ..... 137/312
2005/0166613 A1* 8/2005 Oakner et al. ..... 62/150

* cited by examiner

*Primary Examiner*—Melvin Jones
(74) *Attorney, Agent, or Firm*—Dorothy S. Morse

(57) ABSTRACT

A one-piece liquid-level float switch housing and drain line assembly for use with a collection tray or pan to collect condensate and shut off the source of condensate production when it exceeds a pre-established threshold level. The assembly is configured for rapid connection through a pre-formed drain line opening in the perimeter wall of a condensate collection tray/pan to place the deployable float body within its housing in a level orientation relative to the tray/pan without additional leveling adjustment. The housing has an open bottom and vertically-extending slots providing fluid inlet, debris blocking, and air venting functions for enhanced float body operation. The condensate pan/tray used with the assembly has a nesting configuration that includes a perimeter wall with varying combinations of gussets, curved ribs, angled corner configurations, and support shelves, and a central bottom surface with raised patterns, all of which strengthen the tray/pad during installation and use.

52 Claims, 7 Drawing Sheets

ONE-PIECE FLOAT SWITCH HOUSING AND DRAIN LINE ASSEMBLY WITH CONDENSATE COLLECTION PAN

CROSS-REFERENCES TO RELATED APPLICATIONS

None.

BACKGROUND

1. Field of the Invention

This invention relates to condensate pans and liquid-level float switches, specifically to a one-piece liquid-level float switch housing and drain line assembly for use in combination with a collection tray or pan to collect condensate and shut off the source of condensate production when it exceeds a pre-established threshold level. The present invention tray/pan is preferably made from plastic materials such as ABS or polycarbonate, although not limited thereto, and has a sturdy perimeter wall surrounding a raised central portion, which supports the condensate producing system above the maximum level of condensate anticipated for collection in the tray/pan prior to system shut off. The combination of gussets, ribs, shelves, and other reinforcing structures used in the present invention tray/pan are configured to strengthen the tray/pan against cracking and other potentially deteriorating damage likely to be encountered during its installation, as well as provide the durability needed during its projected long term use for continued support of the weight of the condensate producing system, and any materials needed to raise it to the required height for proper installation, so that the condensate producing system is maintained in a protected position and substantially level orientation during its entire period of use. The particular configuration and unitary construction of the one-piece present invention float switch housing and drain line assembly allows it to be rapidly secured during manufacture, or by the tray/pan installer, through a pre-formed drain line opening in the perimeter wall of its associated condensate collection tray/pan. The opening can be formed during manufacture or by an installer. The configurations of tray/pan support shelf and the complementary mounting plate configuration of the present invention assembly instantly place the float housing, and the movable float body within the housing, into a level orientation relative to the tray/pan. Thus, when the installer places the present invention tray/pan in a substantially level orientation, no additional leveling adjustment of the attached assembly is required to achieve proper, reliable, and reproducible float body deployment. Also, since the tray/pan to be used with the present invention assembly has a sturdy construction and the assembly is not connected over the upper edge of the tray/pan perimeter wall where the float body within the assembly would be at risk to possible lean-in malfunction over time, no leveling adjustment of the present invention float body is anticipated during its entire period of long term use, even when the tray/pan is installed in attics or other places exposed to temperature extremes. Thus, when the present invention assembly is factory-installed, the only adjustment at the time of tray/pan installation might be an optional adjustment of the float body deployment height within the float switch housing member of the assembly, which can be easily custom-set to control the threshold level of condensate collection in the associated tray/pan before the float body activates shut off of the condensate producing system. The float switch housing member of the present invention assembly has slotted openings that provide fluid inlet, debris blocking, and air venting functions. Optionally, the bottom portion of the opening in the drain line connection member of the present invention assembly can be configured with a dam that blocks water flow into the drain line, to extend the amount of time after the threshold condensate level is reached before any of the collected condensate in the associated tray/pan actually moves into the connected drain line. Applications include but are not limited to use in air conditioning condensate collection/overflow prevention applications for shutting off an air conditioning system when collected condensate in a tray/pan beneath the system's air handler exceeds a pre-established threshold amount, as well as other applications where rising condensate/fluid beyond a safe threshold limit is undesirable and automated shut-off of the condensate/fluid source is needed or desired to eliminate back-up damage to the condensate producing system or the risk of damage to surrounding objects and structures.

2. Description of the Related Art

When air conditioning condensate and other condensates are collected in a pan or tray to avoid immediate condensate contact with surrounding objects and structure, risks of overflow and/or back-up into the system producing it remain. As a result, liquid-level float switches have been employed with collection pans and trays to shut-off the source of condensate flow when the amount of condensate collected exceeds a predetermined threshold level considered safe. Currently used air conditioning condensate collection pans have many different upper edge configurations, thickness dimensions, and are made from a variety of plastic and metal materials. This has caused installers and repairmen to maintain a supply of at least several different float switch mounting systems, some adapting better to the thinner upper edge of metal condensate collection pans, and others more suited to the variable thicknesses found in existing plastic condensate collection pans. The goal of the present invention switch is to provide a one-piece liquid-level float switch and drain line assembly and pair it with a condensate tray or pan, both of sturdy construction, that together shorten pan and switch installation time over known prior art devices, facilitate installation, provide stable installation, minimize maintenance after installation, and take the guess-work out of selecting, mounting, and adjusting an appropriately matched float switch and condensate collection pan so as to provide immediate, reliable, and reproducible electrical shut-off action when the condensate collected in the pan exceeds a pre-established or custom-set threshold amount. Further, since air conditioning condensate collection pans are typically installed in hot attics, and other places where significant temperature fluctuations can occur, and also since many plastic condensate collection pans have insufficient construction whereby a float switch mounted on its upper edge will lean in over a period of time and no longer be maintained in the needed vertical orientation for a prompt and reliable response to excessive condensate collection in its associated pan, the present invention is also configured to overcome the lean in problem by placing the air conditioning unit on raised central supports and connecting its float switch assembly to the perimeter wall of the tray/pan near its base through use of support shelf and complementary mounting plate structure, instead of supporting its float switch assembly upon the upper edge of the perimeter wall. Further, when the float switch and drain line assembly of the present invention is factory installed into its desired position of use, installation time of the condensate collecting tray/pan is substantially reduced where the factory set float body deployment height is appropriate to the application and does not require custom adjustment. A slotted housing member of the present invention assembly also protects the float body, providing fluid inlet, debris blockage, and air venting functions, including protection of the float body from insulation fibers and other airborne debris typically found in attics that pose a risk for float body malfunction. It is contemplated in the present invention for the lowest part of the slotted configuration to be lower in height relative to the perimeter wall of the associated tray/pan than the drain line opening in its support shelf so that condensate production can routinely be shut off prior to discharge of any collected condensate through the drain line. Further, the preferred configuration of and means for securing the present invention assembly to an associated condensate collecting tray/pan allows its float body to remain in its preferred orientation for repeated and reproducible deployment during the entire time period of use, and not be subject to changes in orientation over time that occur as a result of sagging or lean in of an associated condensate tray or pan wall. In addition, the present invention assembly and tray/pan have sturdy/rugged designs, sturdy corrosion-resistant construction, with the present invention float body having a large surface area that substantially fills the float housing for a faster water displacement response, with the large surface area also eliminating wobble during activation that could lead to less responsive operation or malfunction. Also, since the present invention assembly has an open bottom configuration that allows collected condensate in the float housing to easily drain so that its float body is not routinely in contact with collected condensate, the float switch body is less likely to become clogged with mold, algae, and/or debris and thus is further protected from malfunction, for continued proper operation of the float switch body during the entire time period of its use. No other apparatus is known that functions in the same manner or provides all of the advantages of the present invention.

BRIEF SUMMARY OF THE INVENTION

It is the primary object of this invention to provide a one-piece liquid-level float switch and drain line assembly that is easily and promptly attached to the perimeter wall of a condensate collecting tray/pan in a position near the base of the wall, thereby allowing the assembly to remain unaltered in position relative to the tray/pan during extended use. It is also an object of this invention to provide a one-piece liquid-level float switch and drain line assembly that is made from corrosion-resistant materials that resist premature deterioration and malfunction. A further object of this invention is to provide a condensate pan or tray and one-piece liquid-level float switch and drain line assembly capable of proper and reliable operation when subjected to temperature extremes. It is a further object of this invention to provide a one-piece liquid-level float switch and drain line assembly with a configuration that facilitates tray/pan installation, shortens tray/pan installation time, may have an optionally adjustable float switch body deployment height, provides stable installation and function for reliable long term use with minimal after-installation inspection or maintenance. It is also an object of this invention to provide a condensate pan or tray for use with a one-piece liquid-level float switch and drain line assembly that has a rugged construction and is made from materials that do not prematurely deteriorate as a result of being exposed to widely fluctuating temperature variations. A further object of this invention is to provide a condensate pan or tray with a factory-installed one-piece liquid-level float switch and drain line assembly that is adapted for prompt shut-off of condensate production when the condensate collected in its tray or pan exceeds a threshold amount pre-established to prevent condensate back-up into the system producing it and/or condensate discharge from the tray/pan that could lead to damage of adjacent objects and structure, including condensate collection/overflow prevention applications relating to air conditioning systems. It is also an object of this invention to provide a one-piece liquid-level float switch and drain line assembly having a configuration that promotes proper and reliable float body operation by facilitating condensate collection within its float housing, providing adequate air venting, and providing adequate blockage of airborne debris, including the loose insulation fibers typically encountered in attics with some air conditioning applications. It is a further object of this invention to provide a condensate pan or tray and one-piece liquid-level float switch and drain line assembly combination that avoids lean in and otherwise provides a fast and reproducible shut-off response. It is also an object of this invention to provide a condensate pan or tray and one-piece liquid-level float switch and drain line assembly combination that enhances reliable float switch operation by protecting its float switch body during long term use against clogging with mold, algae, and/or waterborne debris.

The present invention, when properly made and used, will provide a liquid-level float switch housing and drain line assembly for use in combination with an associated collection tray or pan to collect condensate and shut off the source of condensate production when it exceeds a pre-established threshold level, including the condensate produced by air conditioning systems. The tray/pan is preferably positioned under all or a substantial portion of the condensate producing system, with the condensate producing system supported upon the raised central portion of the tray/pan. The longitudinally-extending ribs, arcuate ribs, and other raised supports in the central portion of the present invention tray/pan are configured to elevate the condensate producing system above the highest anticipated level of condensate to be collected in the tray/pan so as to avoid premature deterioration of the bottom surface of the system. Such ribs and supports are also configured to strengthen the tray/pan against installation cracking and other potentially deteriorating damage, as well as for sturdy and long-term level support of the condensate producing system. The present invention assembly is a unitary piece that can be rapidly secured during manufacture, or by the tray/pan installer, through a pre-formed drain line opening in the perimeter wall of the condensate collection tray/pan. The opening can be factory made, or created by the installer. The connection between present invention assembly and an associated tray/pan can be easily made using a threaded connector and an O-ring, and/or other sealing means or combination that provides a leak-resistant connection between tray/pan and assembly. The present invention assembly and tray/pan can also each be designed so that a mounting plate configured as a part of the assembly laterally overlaps a support shelf configured as a part of the tray/pan perimeter wall to stably align the assembly in its needed position relative to the perimeter wall. A forwardly-extending flange along the front bottom of the drain line connection member of the present invention assembly, as well as the connecting member of the assembly extending between its float housing and drain line connection members, are also configured to contact the inside bottom surface of the tray/pan for additional assistance in obtaining and maintaining the needed level orientation of the float body for its proper and reproducible deployment. The combination of support shelf/mounting plate structure and the forwardly-extending flange provides immediate level orientation of the float body within the assembly when the tray/pan to which it is connected is in a substantially level orientation, and also prevents wobble in the connection between the assembly and the perimeter wall so that the level orientation immediately achieved is maintained during an extended period of use. Thus, the assembly configuration instantly and routinely places the float housing in a level orientation relative to an associated tray/pan, so that when the tray/pan is in a substantially level orientation, no additional leveling of the attached assembly, or the movable float body within the float housing member of the assembly, is required by an installer for proper, reliable, and reproducible float body deployment. Also, since the tray/pan to be used with the present invention assembly has a sturdy construction and the assembly connection to the perimeter wall is made near the base of the perimeter wall, not over its upper edge, no leveling adjustment of the float body is anticipated at any time during its long term use due to perimeter wall sagging or lean-in, even when the tray/pan is installed in attics or other places exposed to temperature extremes. Thus, when the assembly is factory-installed, the only adjustment possibly needed at the time of its installation is an optional adjustment of the deployment height for the float body within its float switch housing, to custom set the maximum depth of condensate collection in the tray/pan prior to float body activation. Since the bottom of the float switch housing is open and a top nut is positioned above the housing to secure the upwardly deployable float body within the housing, a simple unscrewing of the top nut will allow the float body and its movement-guiding shaft to be pushed downwardly through and beyond the housing's bottom opening so that a second nut on the shaft, that is hidden within the float switch housing during use, can be repositioned on the upper threaded portion of the shaft to define a different upper deployment limit for float body movement, as needed The open bottom of the float switch housing also permits collected condensate within the housing to easily drain back into the tray/pan, thus eliminating favorable growth conditions for algae and/or mold that might otherwise interfere with or inhibit proper and reliable float body deployment. Additional cutout areas in the bottom edge of the float switch housing can be made to further assist such drainage. The float switch housing also has slotted openings that provide fluid inlet, debris blocking, and air venting functions, including protection from the loose insulation fibers and other airborne debris typically encountered in attics, where condensate producing air conditioning air handlers are commonly placed. In most applications, the float body in the present invention assembly will be positioned to react to rising levels of collected condensate before any of it enters the drain line connected to the associated tray/pan. A dam can be optionally used over the bottom part of the opening in the drain line connection member of the assembly to block condensate flow into the drain line and thereby extend the amount of time after the threshold level of condensate collection is reached within the tray/pan before any condensate moves into the connected drain line. Further, the preferred condensate pan/tray used with the present invention assembly has varying combinations of gussets of differing size extending inward from its perimeter wall, multiple horizontally-extending curved ribs in the perimeter wall in place of a gusset in areas contemplated for potential float switch housing placement, angled corner configurations, support shelves with a configuration complementary to the mounting plate on the assembly and through which a drain line opening can be made, and a central bottom surface with various raised patterns, all of which strengthen the tray/pad during installation and its extended use in support of a condensate producing system, such as but not limited to an air conditioning system, and protect preferred plastic embodiments of the present invention tray/pan from premature cracking and other potentially deteriorating damage during installation and use. The raised central patterns in the present invention tray/pan are preferably symmetrical, but not limited thereto, and also preferably structured for elevated support of a condensate producing system by various numbers, sizes, and spacing of construction materials or other objects used to raise its height to the elevation required for efficient and proper installation. The raised central patterns of the present invention tray/pan can include differing combinations of longitudinally-extending ribs, horizontally-extending ribs, arcuate ribs, and/or irregularly shaped higher support structures with arcuate and/or linear perimeter configurations, which in combination create a channeled matrix for condensate flow underneath the condensate producing system it supports, while maintaining the bottom of the condensate producing system above the highest anticipated level of collected condensate. In addition, it is preferred for the gussets, raised central patterns, and other features of the present invention pan/tray to have configurations that permit efficient nesting of one tray/pan upon another for compact storage and transport to reduce product costs. Further, the corrosion-resistant materials used for the perimeter wall and raised central portion of the tray/pan, and their thickness dimensions, are also selected to prevent sagging of the central bottom portion and perimeter wall, as a result of hot temperatures in an attic or other installation site subject to extreme and/or fluctuating temperatures, which could lead to float body malfunction and/or collected condensate back-up or overflow. In addition, the float switch body has a large surface area that substantially fills the slotted housing surrounding it for enhanced water displacement, enhanced buoyancy, and responsive operation. Also, the float switch housing member of the present invention assembly also preferably has a threaded aperture centrally through its top surface that is configured for aligning the upper end of the shaft that guides the vertical displacement of the float body within the switch housing of the assembly. Electrical connection between the float body in the assembly and the condensate producing unit supported on the tray/pan is typically through wires extending through the upper portion of the shaft and upwardly beyond the threaded aperture centrally through the top surface of the float switch housing. Further, the placement of high-friction grommets or support pads on the top surface of the raised central supports help to minimize vibration and maintain the supported condensate producing system in a preferred position of use. Thus, the present invention assembly and tray/pan are both designed for fast and efficient installation, as well as for minimal inspection and maintenance after installation.

The description herein provides preferred embodiments of the present invention but should not be construed as limiting its scope. For example, variations in the number, placement, size, and configuration of high-friction grommets or support pads used; the material from which the grommets/pads are made and whether they would be replaceable; the width and depth dimensions of the raised central supports; the spaced apart distance separating the float housing member and the drain line connection member of the assembly that contains a wrap-around mounting plate, the length of the lateral protrusions rearwardly-depending from the mounting plate, and the configuration of the connecting member of the assembly positioned between its float housing and drain line members, other than those shown and described herein, may be incorporated into the present invention. Thus the scope of the present invention should be determined by the appended claims and their legal equivalents, rather than being limited to the examples given.

DETAILED DESCRIPTION OF PREFERRED EMBODIMENTS

Figure 1:
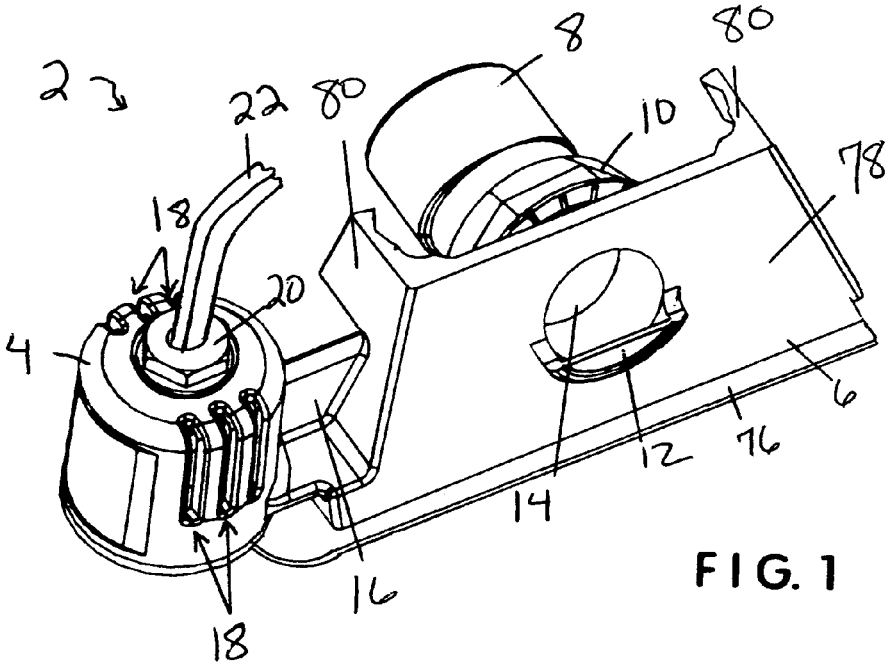
FIG. 1 is a front perspective view of a first preferred embodiment of the present invention one-piece float housing and drain line assembly having a dam over the bottom portion of the drain line bore.

The present invention, when properly made and used, provides a one-piece liquid-level float switch housing and drain line assembly 2, with a float housing member 4 and a drain line connection member 6, for use in combination with an associated collection tray or pan, such as but not limited to the tray/pans 48 and 66 shown in FIGS. 8-11, to collect condensate and shut off the source of condensate production when it exceeds a pre-established threshold level, including the condensate produced by air conditioning systems (not shown). When the words tray, pan, and tray/pan, are used in the ensuing description, unless specifically noted otherwise, such words are intended to be interchangeable and identify the same or similar usable structure. Tray/pan 2 is preferably positioned under the entire condensate producing system (not shown), or a substantial part of it, with the condensate producing system supported upon the raised central portion of the tray/pan 2, which in FIGS. 8-9 include multiple linear ribs 60 and arcuate ribs 62 and in FIGS. 10-11 include elevated supports 68. The longitudinally-extending linear ribs 60, arcuate ribs 62, and elevated supports 68 in the central portion of the present invention tray/pan 2 are configured to elevate the condensate producing system above the highest anticipated level of condensate to be collected in tray/pan 2 so as to avoid premature deterioration of the bottom surface of the system. Such ribs 60 and 62, as well as supports 68 are also configured to eliminate potential stress lines and otherwise strengthen tray/pan 2 against installation cracking and other potentially deteriorating damage, as well as for sturdy and long-term level support of the condensate producing system (not shown). The present invention assembly 2 is a unitary piece that can be rapidly secured during manufacture, or by the tray/pan installer (not shown), through a pre-formed drain line opening 72 in the perimeter wall 74 of condensate collection tray/pan 2. Opening 72 can be factory made, or created by the installer. The connection between present invention assembly 2 and an associated tray/pan (48, 66, or other) can be easily made using a threaded connector 10 and an O-ring 26, and/or other sealing means or combination that provides a leak-resistant connection between tray/pan (48, 66, or other) and assembly 2. The present invention assembly 2 and tray/pan 48 or 66 can also each be designed so that a mounting plate 6 configured as a part of assembly 2 laterally overlaps a support shelf (designated by the number 50 in FIGS. 8-11) configured as a part of the tray/pan perimeter wall 74 to stably align assembly 2 in its needed position relative to perimeter wall 74. A forwardly-extending flange 76 along the front bottom of the drain line connection member 6 of the present invention assembly 2, as well as the connecting member 16 of assembly 2 that extends between float housing member 4 and drain line connection member 6, are also configured to contact the inside bottom surface of the tray/pan (48, 66, or other) for additional assistance in obtaining and maintaining the needed level orientation of the float body (shown in FIG. 5 by the number 40) for its proper and reproducible deployment. The combination structure of support shelf 50, the planar mounting plate 78 of the drain line connection member 6 of assembly 2, the laterally positioned shelf-overlapping protrusions 80 of the drain line connection member 6 of assembly 2, and forwardly-extending flange 76, provides immediate level orientation of the float body 40 within the float housing member 4 of assembly 2 when the tray/pan (48, 66, or other) to which it is connected is in a substantially level orientation, and also prevents wobble in the connection between assembly 2 and the perimeter wall 74 of the tray/pan so that the level orientation immediately achieved is maintained during an extended period of use. Thus, the assembly configuration instantly and routinely places float housing 4 in a level orientation relative to an associated tray/pan (48, 66, or other), so that when the tray/pan is in a substantially level orientation, no additional leveling of the attached assembly 2, or the movable float body 40 within the float housing member 4 of assembly 2, is required by an installer for proper, reliable, and reproducible float body 40 deployment. Also, since the tray/pan (48, 66, or other) to be used with the present invention assembly 2 has a sturdy/rugged construction and the assembly 2 connection to perimeter wall 74 is made near the base of perimeter wall 74, not over its upper edge, no leveling adjustment of the float body 40 is anticipated at any time during its long term use due to perimeter wall 74 sagging or lean-in, even when the tray/pan (48, 66, or other) is installed in attics or other places exposed to temperature extremes. Thus, when assembly 2 is factory-installed into a tray/pan (48, 66, or other), the only adjustment possibly needed at the time of its installation is an optional adjustment of the deployment height for the float body 40 within the float housing member 4 of assembly 2, to custom set the maximum depth of condensate collection in the tray/pan prior to float body 40 activation. Since the bottom of the float housing member 4 is open and a top nut 20 is positioned above the top exterior surface of the float housing member 4 to secure the upwardly deployable float body 40 within float housing member 4, a simple unscrewing of top nut 20 will allow float body 40 and its movement-guiding shaft 38 (shown in FIG. 5) to be pushed downwardly through and beyond the bottom opening in the float housing member 4 of assembly 2 so that a second deployment defining nut 34 on shaft 38, that is hidden within the float housing member 4 of assembly 2 during use, can be repositioned on the upper threaded portion 36 of shaft 38 to define a different upper deployment limit for float body 40 movement, as needed The open bottom of the float housing member 4 of assembly 2 also permits collected condensate (not shown) within the float housing member 4 to easily drain back into the tray/pan (48, 66, or other), thus eliminating favorable growth conditions for algae and/or mold that might otherwise interfere with or inhibit proper and reliable float body 40 deployment. Additional cutout areas 78 can be formed in the bottom edge of float housing member 4 to further facilitate drainage, as needed. The float housing member 4 of assembly 2 also has slotted openings 18 that provide fluid inlet, debris blocking, and air venting functions, including protection from the loose insulation fibers and other airborne debris typically encountered in attics, where condensate producing air conditioning air handlers are commonly placed. In most applications, the float body 40 in the present invention assembly 2 will be positioned to react to rising levels of collected condensate before any of it enters the drain line connection member 8 positioned beyond the perimeter wall 74 of the associated tray/pan (48, 66, or other). A dam 12 can be optionally used over the bottom part of the bore 14 in the drain line connection member 6 of assembly 2 to block condensate flow into drain line connection member 8 and thereby extend the amount of time after the threshold level of condensate collection is reached within the tray/pan (48, 66, or other) before any condensate moves into drain line connection member 8. Dam 12 can be manufactured with a breakout structure so that it can be easily removed by an installer if not needed at the installation site. Further, the preferred condensate pan/tray (48, 66, or other) used with the present invention assembly has varying combinations of gussets 52 of differing size extending inward from its perimeter wall 74, multiple spaced-apart horizontally-extending curved ribs 58 in the perimeter wall 74 in place of a gusset 52 in areas contemplated for potential float housing member 4 placement, angled corner configurations 54, support shelves 50 with a configuration complementary to the mounting plate 78 on the drain line connection member 6 of assembly 2 and through which a drain line opening 72 (shown in FIG. 8) can be made, and a central bottom surface with various raised patterns that include linear ribs 60, arcuate ribs 62, and elevated central supports 68, all of which strengthen the tray/pad 48 and 66 during installation and its extended use in support of a condensate producing system, such as but not limited to an air conditioning system, and protect preferred plastic embodiments of the present invention tray/pan 48 and 66 from premature cracking and other potentially deteriorating damage during installation and use. The raised central patterns in the present invention trays/pans 48 and 66 are preferably symmetrical, but not limited thereto, and also preferably structured for level elevated support of a condensate producing system by various numbers, sizes, and spacing of construction materials or other objects (not shown) used to raise its height for efficient and proper installation. The raised central patterns of the present invention tray/pan 48 and 66 can include differing combinations of longitudinally-extending linear ribs 60, horizontally-extending ribs (not shown), arcuate ribs 62, and/or irregularly shaped elevated support structures 68 with arcuate and/or linear perimeter configurations, which in combination create a channeled matrix for condensate flow underneath the condensate producing system it supports, while maintaining the bottom of the condensate producing system above the highest anticipated level of collected condensate. In addition, it is preferred for the gussets 52, elevated central supports 68, and other features of the present invention pan/tray (48, 66, or other) to have configurations that permit efficient nesting of one tray/pan upon another for compact storage and transport to reduce product costs. Further, the corrosion-resistant materials used for the perimeter wall 74 and elevated central portion of the tray/pan (48, 66, or other), and their thickness dimensions, are also selected to prevent sagging of the central bottom portion and perimeter wall 74, as a result of hot temperatures in an attic or other installation site subject to extreme and/or fluctuating temperatures, which could lead to float body 40 malfunction and/or collected condensate back-up or overflow. In addition, float body 40 has a large surface area that substantially fills the slotted float housing member 4 of assembly 2 surrounding it for enhanced water displacement, enhanced buoyancy, and responsive operation. Also, the float housing member 4 of the present invention assembly 2 also preferably has a threaded aperture 32 centrally through its top surface that is configured for aligning the upper end of the shaft 38 (shown in FIG. 5) that guides the vertical displacement of the float body 40 within the switch housing member 4 of assembly 2. Electrical connection between the float body 40 in assembly 2 and the condensate producing unit supported on the tray/pan (48, 66, or other) is typically through wires 22 (See FIG. 1) extending through the upper portion of the shaft 38 and upwardly beyond the threaded opening 32 centrally through the top surface of float housing member 4. Further, the placement of high-friction grommets or support pads 70 on the top surface of the elevated central supports 68 help to minimize vibration and maintain the supported condensate producing system in a preferred position of use. Thus, the present invention assembly 2 and tray/pan 48, 66, and other non-patentably distinct variations thereof, are designed for fast and efficient installation, as well as for minimal inspection and maintenance after installation.

Figure 3:
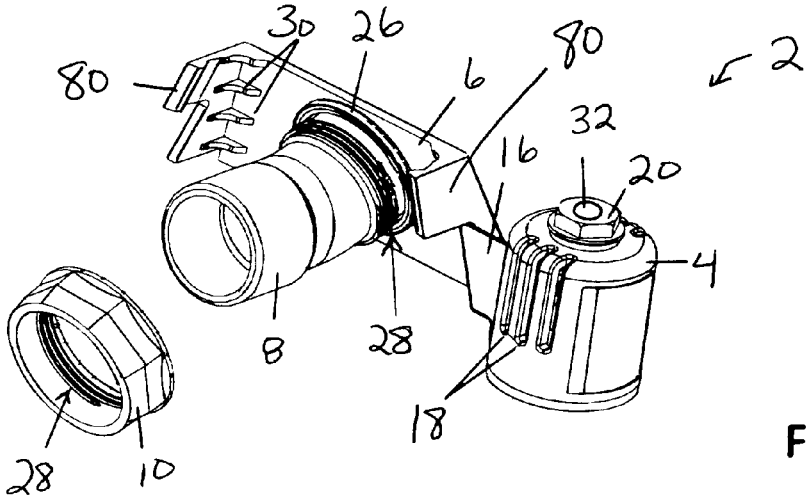
FIG. 3 is a rear perspective view of a third preferred embodiment of the present invention one-piece float housing and drain line assembly with no plug in its drain line connection member, with its threaded connection nut separated from its usable position against the O-ring, and with several vertically spaced-apart reinforcing corner ribs.
Figure 4:
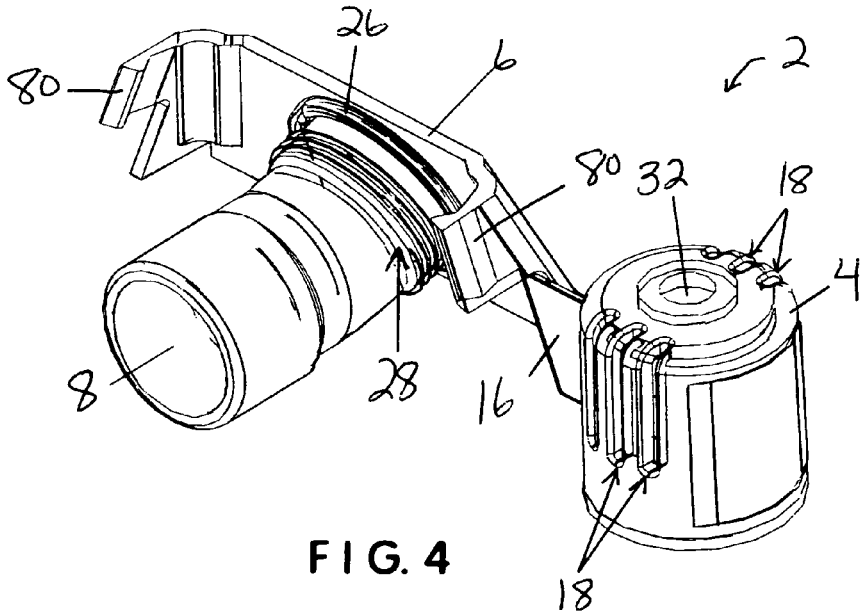
FIG. 4 is a rear perspective view of a fourth preferred embodiment of the present invention one-piece float housing and drain line assembly similar to that shown in FIG. 2 but without the bottom edge cutout areas/indentation in the float housing member that facilitate drainage of condensate from around the float body inside it, and also with no plug in its drain line connection member, with its threaded connection nut removed, and with the top nut removed from the float housing.
Figure 5:
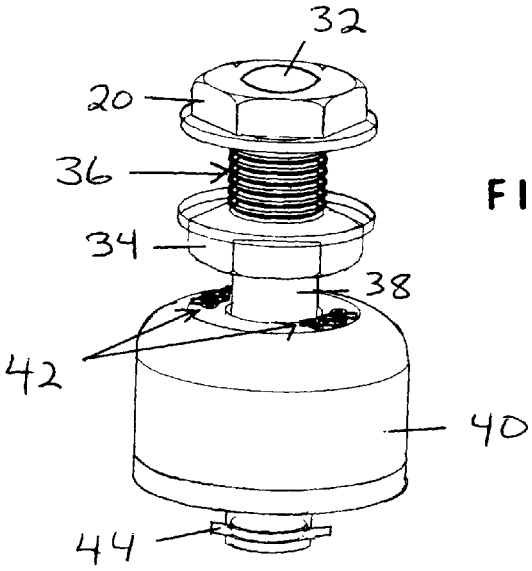
FIG. 5 is a side view of the most preferred embodiments of float body, deployment shaft top nut, and deployment height adjusting nut used within the float housing member of the present invention assembly.
Figure 6:
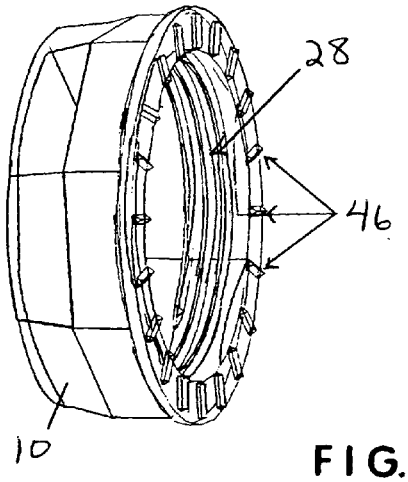
FIG. 6 is a side view of the most preferred threaded connection nut used with the drain connection member of the present invention assembly.
Figure 7:
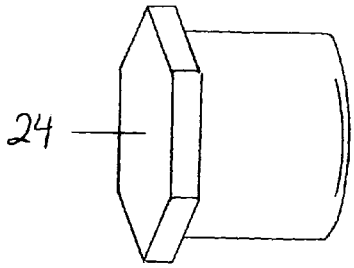
FIG. 7 is a side view of the most preferred plug used with the drain connection member of the present invention assembly.
Figure 8:
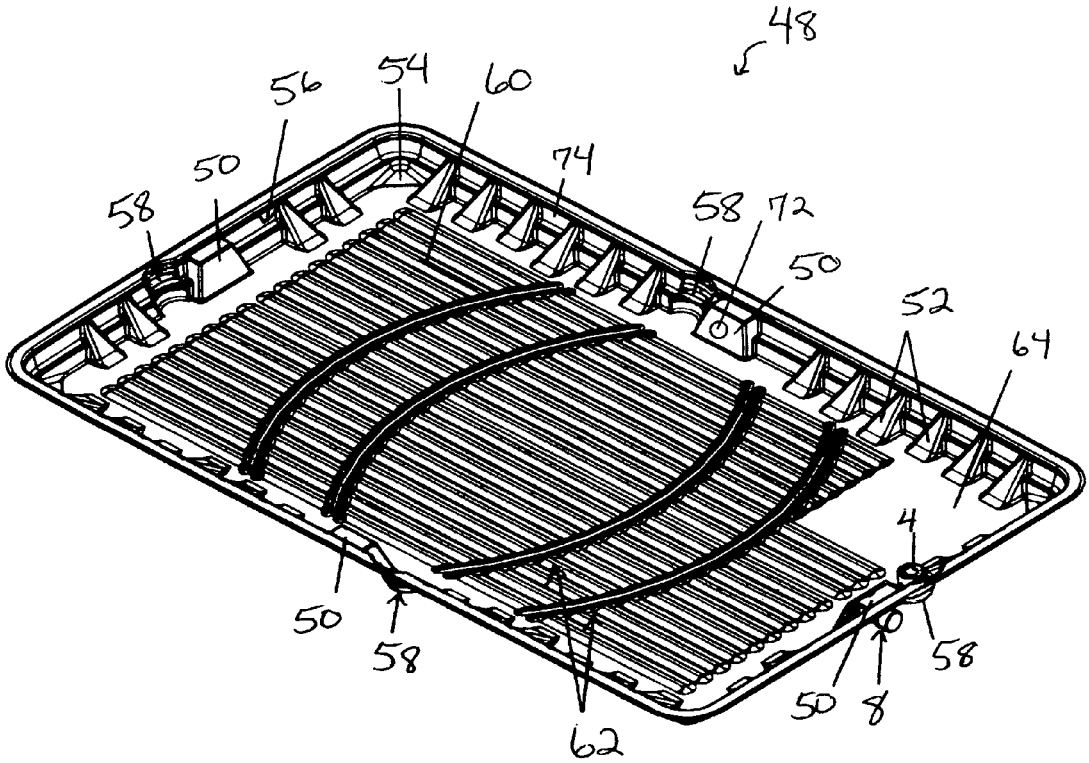
FIG. 8 is a perspective top view of a first preferred embodiment of a condensate collection pan contemplated for use with the present invention assembly and having a raised central portion, a perimeter wall, a plurality of gussets between the central portion and the wall, an assembly-mounting support shelf on each wall, a horizontally-extending ribbed configuration adjacent to each support shelf, an assembly mounted on one support shelf, angled corner supports, a horizontally-extending ridge on the wall between adjacent gussets and above the angled corner supports, and the raised pattern in the central portion having multiple linear and arcuate ribs.
Figure 9:
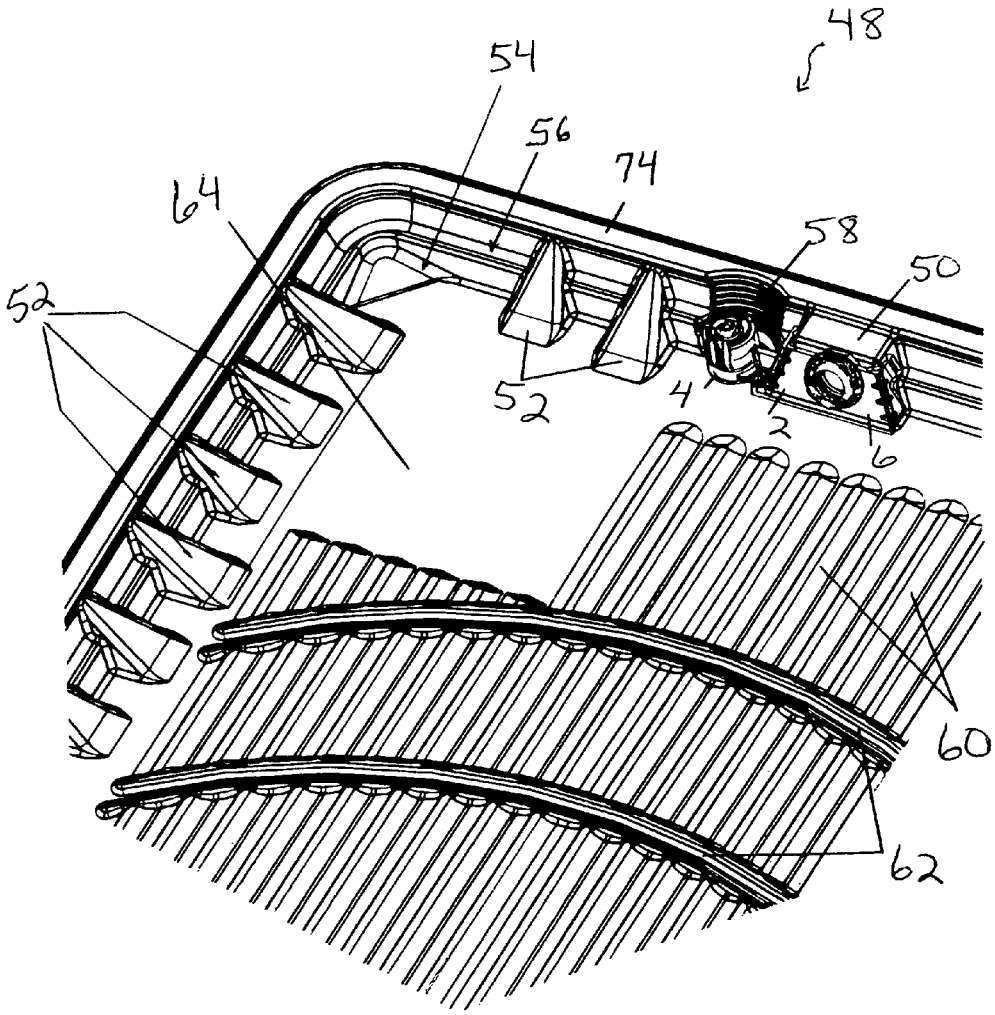
FIG. 9 is an enlarged perspective view of one corner of the first embodiment of present invention condensate collection pan.
Figure 10:
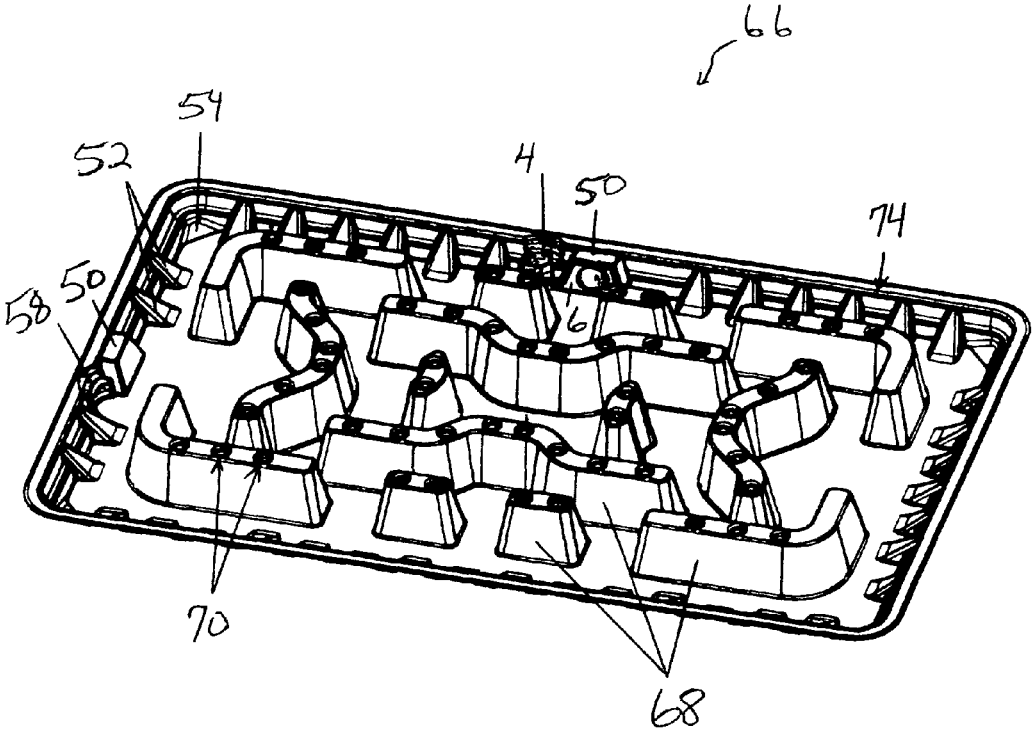
FIG. 10 is a perspective top view of a second preferred embodiment of a condensate collection pan contemplated for use with the present invention assembly and having a central portion with multiple risers spaced apart from one another, a perimeter wall, a plurality of gussets between the central portion and the wall, an assembly-mounting support shelf on two walls, a horizontally-extending ribbed configuration adjacent to each support shelf, an assembly mounted on one support shelf, angled corner supports, and a horizontally-extending ridge on the wall between adjacent gussets and above the angled corner supports.
Figure 11:
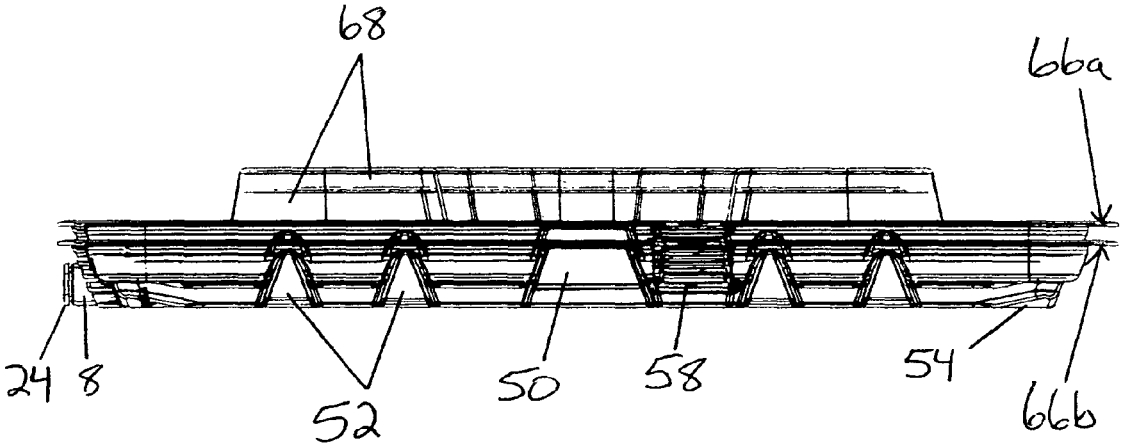
FIG. 11 is a side view of two second preferred embodiment condensate collection pans nested together for compact storage and transportation.

FIGS. 1-4 show the most preferred embodiment of the present invention one-piece float housing and drain line assembly 2, with FIGS. 5-7 showing additional components used therewith for stable positioning against the perimeter wall of a tray/pan (48, 66, or other) and allowing it to fulfill its condensate production shut-off function. FIGS. 8 and 9 show one preferred tray/pan embodiment 48 having longitudinally-extending ribs and generally laterally-extending arcuate ribs, with FIGS. 10 and 11 showing a second preferred tray/pan embodiment 66 having raised central supports 68. However, while FIGS. 1-11 herein show the most preferred embodiments of the present invention, it is to be understood that many variations in the present invention are possible and also considered to be a part of the invention disclosed herein, even though such variations are not specifically mentioned or shown. As a result, a reader should determine the scope of the present invention by the appended claims.

FIG. 1 shows a first preferred embodiment of the present invention one-piece float housing and drain line assembly 2 having a float housing member 4 and a mounting plate portion 6 that are securely fixed to one another in a non-movable orientation by a connecting member 16. Throughout the invention disclosure herein, mounting plate portion 6 may also be referred to as drain line connection member 6. A front flange 76 further adds strength to float housing member 4, mounting plate portion 6, and connecting member 16. Further, the combination of planar mounting plate 78 of the drain line connection member 6 of assembly 2, the laterally positioned shelf-overlapping protrusions 80 of the drain line connection member 6 of assembly 2, and the forwardly-extending flange 76, provides immediate level orientation of the float body 40 (hidden from view in FIG. 1, but shown in FIG. 5) within the float housing member 4 of assembly 2 when the tray/pan (48, 66, or other) to which it is connected is in a substantially level orientation, and also prevents wobble in the connection between assembly 2 and the perimeter wall 74 of the tray/pan (48, 66, or other) so that the level orientation immediately achieved is maintained during an extended period of use. Behind the mounting plate 78 in the drain line connection member 6 of assembly 2, FIG. 1 further shows drain line connection member 8 and threaded connector 10, with the drain line bore 14 through mounting plate 78 and the preferred breakout dam 12 over the bottom portion of drain line bore 14 being identified in the front of mounting plate 78. FIG. 1 also shows float housing member 4 having multiple vertically-extending slots 18 through its side and top surfaces, which provide fluid inlet, debris-blocking, and air venting functions. In addition, FIG. 1 shows float housing member 4 having a top nut 20 and electrical wires 22 extending upwardly and centrally through top nut 20. The configuration and size of connecting member 16, dam 12, and shelf-overlapping protrusions 80 may differ from that shown in FIG. 1. Also, the number of slots 18 in float housing member 4 may be more or less than shown in FIG. 1, according to the intended application, and slots 18 may be greater in width dimension than shown. In addition, it is contemplated to be a part of the present invention for flange 76 to have different depth and height dimensions than shown in FIG. 1, and the length of drain line connection member 8 to also be different from than shown in FIG. 1. Further, although the diameter dimension of float housing member 4 may be different in proportional size relative the mounting plate 78, the proportion shown is preferred. Although not limited thereto, and only by way of example, dimensions for one preferred embodiment of one-piece float housing and drain line assembly 2 include a float housing member 4 having an outside diameter dimension of approximately one-and-one-fourth inches, a height dimension of one-and-one-half inches, slots 18 having a length dimension of approximately one inch, and an inside diameter dimension close to one inch. Corresponding dimensions in the preferred embodiment of one-piece float housing and drain line assembly 2 provided immediately above as an example, for connecting member 16 include a length dimension that creates a spaced-apart separation of float housing member 4 and mounting plate portion 6 of approximately one-and-one-fourth inches, a height dimension of between approximately one-half inches approximately three-fourths inches, and a thickness dimension of approximately one-eighth of an inch, and the most preferred dimensions in the same assembly 2 example for mounting plate portion 6 include width and height dimensions for the front face of mounting plate 78 of approximately two-and-one-half inches and nearly two inches, a flange 76 having a depth dimension of approximately one-fourth of an inch, and a drain line connection member 8 with a distal end more than two inches from the rear surface of mounting plate 78. Again, it should be understood that such dimensions are representative only, and it is within the scope of the present invention to include various components with alternative dimensions. It is also preferred that drain line connection member 8 have a diameter dimension appropriate for easy connection to standard sizes of conduit and/or other tubing (not shown) that might be used to transport excess condensate to a location remote from tray/pan 48, 66, or other. However, in the alternative, custom dimensions of drain line connection member 8 are also considered to be within the scope of the present invention.

Figure 2:
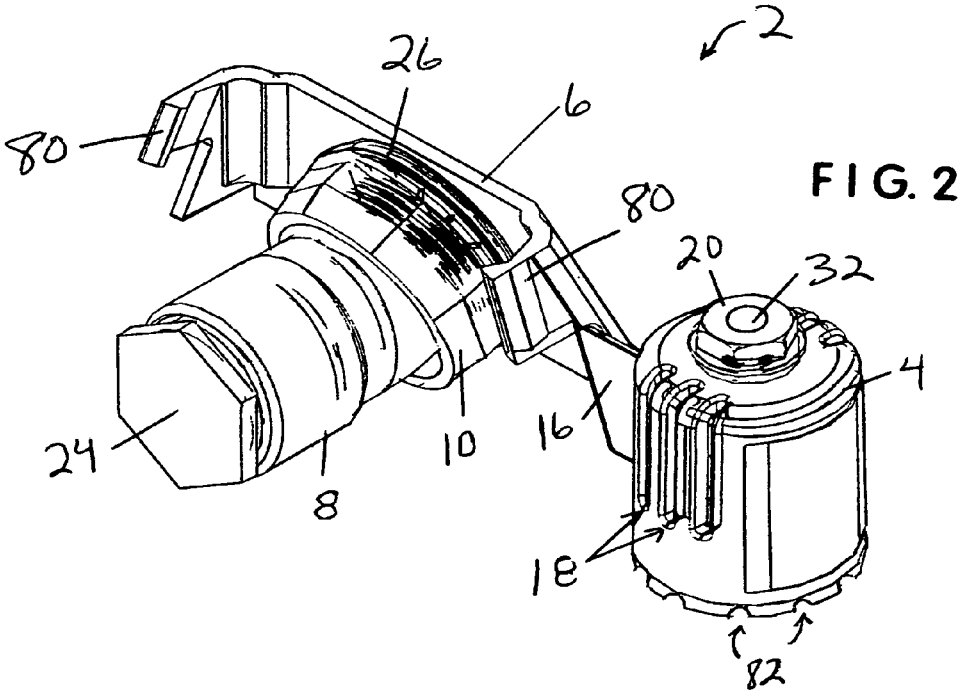
FIG. 2 is a rear perspective view of a second preferred embodiment of the present invention one-piece float housing and drain line assembly showing a plug in its drain line connection member, as well as the preferred O-ring and threaded connection nut used for secure attachment of the assembly to a condensate collection tray/pan, with the float housing having cutout areas on its bottom edge that facilitate condensate drainage.

FIG. 2 shows a second preferred embodiment of the present invention one-piece float housing and drain line assembly 2 with a plug 24 in the distal end of its drain line connection member 8, as well as the preferred O-ring 26 and threaded connection nut 10 being used for secure watertight attachment of the assembly to a condensate collection tray/pan, such as but not limited to tray/pan 48 in FIGS. 8 and 9 or tray/pan 66 in FIGS. 10 and 11. FIG. 2 also shows the opposed overlapping lateral protrusions 80 having a wrap-around configuration for secure positioning relative to a support shelf 50 on a supporting tray/pan (48, 66, or other). It is contemplated for the wrap-around configuration of protrusions 80 to align mounting plate 78 with support shelf 50 for less wiggle and instant leveling of the float body 40 with the associated tray/pan (48, 66, or other) so that additional leveling action is not required during installation. As in FIG. 1, connecting member 16 depends between float housing member 4 and the adjacent one of the lateral protrusions 80 in mounting plate portion 6 to securely fix one to the other. Also, as in FIG. 1, FIG. 2 shows float housing member 4 having multiple vertically-extending slots 18 that perform fluid inlet, air venting, and debris blocking functions, and a top nut 20 with a central top opening 32 therein. Top nut 20 is used to secure a float body 40 and its guide shaft 38 for vertical deployment within float housing 4. However, in contrast to FIG. 1, FIG. 2 does not show wires 22 extending from top opening 32 and the float housing 4 in FIG. 2 has cutout areas/indentations 82 on its bottom edge that facilitate condensate drainage from around float body 40 so that molds and algae are discouraged from growing within the float housing member 4 where they could otherwise inhibit a responsive and reliable float body 40 deployment when needed to prevent condensate back-up or overflow. It is not critical for the end configuration of plug 24 to be hexagonal, however, it should have a configuration that facilitates its manipulation and installation. Plug 24 is typically added by an installer (not shown) in the distal end of a drain line connection member 8 in a pre-installed assembly 2 secured through a pre-formed drain line opening 72 in a tray/pan support shelf 50, when the installer has an on-site need to use another support shelf 50 for connecting a drain line to the tray/pan and uses another assembly 2 in the alternative installer-drilled opening 72 in a support shelf 50 elsewhere on the tray/pan (48, 66, or other).

FIG. 3 shows a third preferred embodiment of the present invention one-piece float housing and drain line assembly 2 which is similar to that shown in FIG. 2 with the exception of several optional vertically spaced-apart reinforcing corner ribs 30 configured to strengthen the connection of shelf-overlapping lateral protrusions 80 around the sides of a support shelf 50 in a tray/pan (48, 66, or other). Although not visible in FIG. 3, it is contemplated for several vertically spaced-apart reinforcing corner ribs 30 to be present and supporting the opposed lateral protrusion 80. In addition, in FIG. 3 threaded connection nut 10 is separated from its usable position against the O-ring 26, with O-ring 26 still in its preferred position of use against the back surface of mounting plate 78. Although not shown, in the alternative when O-ring 26 is used with pan/tray 48 in FIGS. 8 and 9, or pan/tray 66 in FIGS. 10 and 11, O-ring 26 could be positioned between the rear surface of mounting plate 78 and the front surface of the support shelf (see number 50 in FIG. 9), between the rear surface of the support shelf 50 and threaded connection nut 10, or two O-rings 26 could be used for the needed watertight connection in some applications with one O-ring 26 in each of the aforementioned locations. FIG. 3 also illustrates threads 28 on the inside surface of connection nut 10 and the outside surface of proximal portion of drain line connection member 8 adjacent to O-ring 26, which are substantially hidden in FIG. 2. Further, FIG. 3 is different from FIG. 2 in that the embodiment of assembly 2 in FIG. 3 has no plug 24 secured in the distal end of drain line connection member 8, and no cutout areas/indentations 82 on the bottom edge of float housing 4 that facilitate condensate drainage from around float body 40 so that molds and algae are discouraged from growing within the float housing member 4 where they could otherwise inhibit a responsive and reliable float body 40 deployment when needed to prevent condensate back-up or overflow. Top nut 20 and the opening 32 through which wires 22 used to connect float body 40 movement to a condensate producing system are shown in both FIGS. 2 and 3.

FIG. 4 shows a fourth preferred embodiment of the present invention one-piece float housing and drain line assembly 2 that is very similar to that shown in FIGS. 1-3. It would be identical to the second preferred embodiment shown in FIG. 2, except that there are no cutout areas/indentations 82 in the bottom edge of float housing member 4 to facilitate condensate drainage from around float body 40 so that molds and algae are discouraged from growing within the float housing member 4 where they could otherwise inhibit a responsive and reliable float body 40 deployment when needed to prevent condensate back-up or overflow. FIG. 4 is also different from the third embodiment of assembly shown in FIG. 3 since the fourth embodiment of assembly shown in FIG. 4 has no vertically spaced-apart reinforcing corner ribs 30 to further strengthen shelf-overlapping lateral protrusions 80. The fourth embodiment shown in FIG. 4 could be identical to the first embodiment shown in FIG. 1, if the fourth embodiment would have a similarly configured and dimensioned dam 12 and flange 76 (both hidden from view in FIG. 4. In addition, FIG. 4 shows no plug 24 secured in the distal end of its drain line connection member 8, threaded connection nut 10 removed and not visible in the illustration, and top nut 20 removed from the top end of float housing member 4.

FIGS. 5-7 respectively show the other components needed with one-piece assembly 2 for proper and level installation of assembly condensate on a tray/pan (48, 66, or other), and to produce condensate producing system shut-off. FIG. 5 shows the most preferred embodiments of float body 40, deployment shaft 38, top nut 20, upper deployment height-adjusting nut 34, and lower stop 44 used within the float housing member 4 of the present invention assembly 2. In addition, FIG. 5 shows optional informational markings 42 on the top surface of float body 40, which assist an installer manipulating the height-adjusting nut 34 in properly reassembling float body 4 and guide shaft 38 should they become separated during the height adjustment process. Although not shown in FIG. 6, informational markings 42 may also be placed on the bottom surface of float body 40. Typically, the information markings 42 on the top surface of float body 40 would include one or more repetitions of the word "TOP", and when also used on the bottom surface of float body 40, such information markings 42 would typically include one or more repetitions of the word "BOTTOM". FIG. 6 shows the most preferred embodiment of threaded connection nut 10 used with an O-ring 26 to securely position the drain connection member of the present invention assembly 2 in a proper position of use against a tray/pan (48, 66, or other) for reliable and reproducible float body 40 deployment to avert condensate back-up or overflow. FIG. 6 further shows the preferred grips 46 for securely engaging O-ring 26 when connection nut 10 is placed into its preferred position of use. The dimension and configuration of threads 28 and grips 42 can be different from that shown in FIG. 6, as long as each is able to provide a waterproof connection of assembly 2 to a tray/pan (48, 66, or other). FIG. 7 shows the most preferred embodiment of plug 24 used with the drain connection member 6 of the present invention assembly 2. The configuration of plug 24 is not critical as long as its head can be easily manipulated and its length and diameter dimensions are sufficient to achieve a leak-proof connection blocking of condensate beyond the distal end of drain line connection member 8. An illustration for an enlarged O-ring 26 is not included, as it has no special features beyond that of the conventional type of O-ring commonly used in so many applications.

FIGS. 8 and 9 show a first preferred embodiment of a condensate collection pan/tray 48 contemplated for use with the present invention assembly 2. FIG. 8 shows condensate collection pan/tray 48 having a raised central portion, a perimeter wall 74, a plurality of gussets 52 between the central portion and perimeter wall 74, an assembly-mounting support shelf 50 on each wall, a horizontally-extending concave ribbed configuration 58 adjacent to each support shelf 50, an assembly 2 mounted on the support shelf 50 in the right-hand portion of the illustration, angled corner supports 54, and a horizontally-extending ridge 56 on perimeter wall 74 between adjacent gussets 52 and above the angled corner supports 54. All are configured for strengthening pan/tray 48 from premature cracking and/or deterioration during installation and use. FIG. 8 shows the raised pattern in the central portion of pan/tray 48 having a two-part configuration consisting of multiple longitudinally-extending linear ribs 60 and several substantially laterally-extending arcuate ribs 62. Gussets 52 are purposefully staggered in length dimension, so as not to create a stress line in pan/tray 48 that would crack during or after its installation. However, the height of all gussets 52 is nearly identical. The height of gussets 52 exceeds that of horizontally-extending ridge 56, which extends around all sides of pan/tray 48, while the height of the strengthening angled corner supports 54 does not generally extend above horizontally-extending ridge 56, although it could if doing so strengthened pan/tray 48. Typically for air conditioning condensate collection applications, although not limited thereto, ribs 60 and 62 extend no closer to perimeter wall 74 than a distance of approximately two inches. The horizontally-extending concave ribbed configuration 58 is needed for the installation of float housing member 4 so as to leaving adequate maintenance space around the condensate-producing system placed upon ribs 60 and 62. However, its ribbed configuration is used to add strength to the perimeter wall 74 of pan/tray 48, otherwise a simple non-ribbed concave space adjacent to support shelf 50 would become a weak spot in perimeter wall 74 during the installation and use of pan/tray 48. The number and spacing of ribs 60 and 62 are not critical, as long as their configuration is sufficient for extended support a condensate-producing system above the anticipated threshold level of condensate collection in pan/tray 48. FIG. 8 also shows an area 64 lacking ribs 60 that can be used for raised informational marking (as shown by the number 42 in FIG. 5) or applying a label (not shown) with manufacturer information, instructions for use, or helpful suggestions and/or precautions. While the size of area 64 is not critical, it should not be so large as to interfere with the capability of pan/tray 48 to levelly support a condensate-producing system (not shown) on ribs 60 and 62. In contrast, FIG. 9 shows one corner of the first embodiment of present invention condensate collection pan/tray 48 with enlarged detail, to include perimeter wall 74, multiple gussets 52 adjacent to perimeter wall 74, an assembly-mounting support shelf 50 adjacent to one portion of perimeter wall 74 wall, a horizontally-extending concave ribbed configuration 58 adjacent to support shelf 50, an assembly 2 mounted on the support shelf 50, an angled corner support 54 between the gussets on adjoining sections of perimeter wall 74, and horizontally-extending ridge 56 on perimeter wall 74 between gussets 52 and above the angled corner supports 54. FIG. 9 also shows greater detail for the configuration of ribs 60 and 62 in the central portion of pan/tray 48, as well as the area 64 where no ribs 60 or 62 are present, which can be used for informational markings 42, manufacturer information, instructions for use, helpful suggestions and/or precautions, designs, logos, and/or other items according to desire or need.

FIGS. 10 and 11 show a second preferred embodiment of a condensate collection pan/tray 66 contemplated for use with the present invention assembly 2. FIG. 10 shows condensate collection pan/tray 66 having a central portion with multiple condensate system supporting risers 68 spaced apart from one another, a perimeter wall 74, a plurality of gussets 52 between the central portion and perimeter wall 74, an assembly-mounting support shelf 50 on two portions of perimeter wall 74, a horizontally-extending concave ribbed configuration 58 adjacent to each support shelf 50, an assembly mounted on one of the two support shelves 50 and having a drain line connection member 6 and a float housing member 4, angled corner supports 54, and a horizontally-extending ridge 56 on perimeter wall 74 between adjacent gussets 53 and extending above the angled corner supports 54. Although present in FIG. 10, the connecting member 16 (shown in FIGS. 1-4) between drain line connection member 6 and a float housing member 4 is not identified in FIG. 10 for clarity of illustration. Further, while a symmetrical arrangement of elevated central supports/risers 68 is preferred, as shown in FIG. 10, such arrangement is not critical. Also, the height of elevated central supports/risers 68 can vary, and would be set during manufacture to assist installers in raising a condensate-producing system to an appropriate height for easy and prompt installation. The grommets 70 identified on the top surface of elevated central supports/risers 68 should be sufficiently numerous and large to reduce vibration in the condensate-producing system located on them, as well as maintain the condensate-producing system in its optimum position of use above pan/tray 66. It is also preferred for grommets 70 to be made from resilient high-friction material, such as rubber or silicone, although not limited thereto. One determining factor behind the placement of elevated central supports/risers 68 is the level support of pieces of construction material and other items used to shim the condensate-producing system to the appropriate height above pan/tray 66 for connection to other system components and/or equipment. Ideally, elevated central supports/risers 68 should be positioned for lateral placement of construction material, longitudinal placement of construction material, and oblique placement of construction material to make the installer's job of level positioning of the condensate-producing system faster and easier. Thus, pattern, dimensions, and positioning of elevated central supports/risers 68 can be different from that shown in FIG. 10 and still be within the scope of the present invention, however the length, width, and height dimensions of elevated central supports/risers 68, as well as the height and thickness dimensions of perimeter wall 74, should be appropriate to the intended application and not so overly large as to create material waste. FIG. 11 shows two second preferred embodiment condensate collection pans/trays 66 nested together for compact storage and transportation. It is contemplated for all features and components of the present invention pans/trays 48 and 66, but not limited thereto, to be configured for optimal nesting to minimize transportation and storage costs.

It is contemplated for the present invention pans/trays 48, 66, and other embodiments to replace metal pans (not shown) that rust out when the air conditioning air handlers they support sweat and produce condensation, and for assembly 2 to be used with the present invention pans/trays 48, 66, and other embodiments. However, in the reverse it is contemplated assembly 2 to also be used with prior art trays/pans, even though use of the present invention pan/trays 48, 66, and other embodiments will significantly reduce installation times. When the present invention assembly 2 and a pan/tray 48, 66, or other with a support shelf 50 are used together, assembly 2 can be rapidly secured during manufacture or by an installer through a pre-formed drain line opening 72 in the pan's/tray's perimeter wall 74. Such connection can be easily made using a threaded connector 10 and an O-ring 26 or other seal (not shown) that in combination provide a leak-resistant connection. For most expeditious installation, threaded connector 10 and O-ring 26 are preferred. It is contemplated for the drain line opening 72 in the tray/pan (48, 66, or other embodiment) to be made during manufacture and the assembly 2 installed in its usable position adjacent to one of its inside perimeter walls 74, prior to purchase. However, if the application dictates moving the assembly 2 to a position other than the provided by the manufacturer, an installer can rapidly drill or cut a second drain line opening 72 in another location and install therein the original assembly 2 or a second one. If the original assembly 2 is moved, the original drain line opening 72 must be plugged or blocked by the installer, otherwise when a second assembly 2 is used in the newly cut or drilled opening 72, the original assembly 2 is not moved and remains in its original location, with means being taken to plug or block condensate flow therethrough, such as with plug 24, but not limited thereto. When the assembly 2 is installed prior to manufacture, the only adjustment to be made by the installer prior to positioning the tray/pan (48, 66, or other embodiment) under an air conditioning air handler unit is an optional adjustment of the float body 40 deployment height within the float switch housing member 4 of assembly 2, if such action is required by the specific application. Also, although not limited thereto, it is preferred for the present invention pans/trays 48, 66, and other embodiments to be made from polycarbonate or an ABS/polycarbonate blend that is impervious to corrosion, and for the manufacture to be by injection molding or thermoform construction. Resistance to UV radiation is not necessarily a contemplated feature of the present invention, unless dictated by the application. The choice of manufacturing for differing applications would be determined by the anticipated purchase cost to consumers and the expected duration of use without maintenance, parts replacement, or repair. In addition, size of the present invention is not critical, however cost considerations would be a factor in deciding the dimensions of most preferred embodiment 2. Minimal maintenance is contemplated.

What is claimed is:

1. A one-piece assembly for use with a source of condensate production and a condensate collection pan having a preformed drain line opening, said assembly also used with a vertically deployable float body that rises with rising levels of collected condensate and sends a signal to shut off the source of condensate production when a pre-established threshold level of collected condensate is reached in the pan, said assembly comprising:

a liquid-level float switch housing member having a hollow interior with diameter and height dimensions configured for vertical movement therein of a deployable float body, said housing also having a slotted configuration adapted for providing fluid inlet, debris blocking, and air venting functions for reliability of float body deployment, said housing further having an open bottom end and a top opening; and a drain line connection member secured in fixed orientation to said float switch housing member, said drain line connection member configured with a substantially planar mounting plate having a drain line bore therethrough, said drain line connection member also having a drain line connector rearwardly-depending from said mounting plate, and wherein said drain line connection member further comprises opposed and substantially rearwardly-depending lateral protrusions configured for securely engaging complementary stabilizing support structure associated with the preformed drain line opening of a condensate collection pan.

2. The assembly of claim 1 wherein said drain line connection member further comprises at least one horizontally-extending corner rib secured between said mounting plate and each of said rearwardly-depending lateral protrusions.

3. The assembly of claim 1 further comprising a rigid connection member secured in fixed orientation between said liquid-level float switch housing member and said drain line connection member.

4. The assembly of claim 1 wherein said float switch housing member has a bottom edge and at least one cutout area in said bottom edge adapted to improve condensate drainage from float switch housing member.

5. The assembly of claim 1 wherein said liquid-level float switch housing member and said drain line connection member are made from sturdy plastic materials.

6. The assembly of claim 1 wherein said drain line connection member has a bottom front edge and a flange forwardly-extending from said bottom front edge.

7. The assembly of claim 1 wherein said drain line bore of said mounting plate has a bottom portion, and further comprising a dam positioned to block condensate flow through said bottom portion, and where said dam is selected from a group consisting of permanently installed dams and breakout dams that can be readily removed from their manufactured position via hand pressure.

8. The assembly of claim 1 further comprising male threads behind said mounting plate on said drain line connection member, in close proximity to said mounting plate.

9. The assembly of claim 1 further comprising a condensate collection pan having structure around its preformed drain line opening that is complementary to that of said substantially planar mounting plate and configured to securely mate with said mounting plate for long-term fixed positioning of said float switch housing member relative to said pan to prevent changes in said float switch housing member relative to said pan over time that could lead to malfunction of a deployable float body within said float switch housing member.

10. The assembly of claim 9 wherein said structure around said preformed drain line opening is configured as a support shelf.

11. The assembly of claim 9 wherein said pan further comprises structure-strengthening features selected from a group consisting of gussets, horizontally-extending curved ribs, angled corner configurations, horizontally-extending ridges between adjacent gussets, and support shelves in association with a perimeter wall, and raised patterns on a central bottom surface with and without attached high friction grommets.

12. The assembly of claim 11 wherein said curved ribs, angled corner configurations, support shelves and raised patterns each have a nesting configuration.

13. The assembly of claim 11 wherein said horizontally-extending curved ribs are each positioned on said perimeter wall adjacent to one of said support shelves.

14. The assembly of claim 11 wherein said central bottom surface has an area void of said raised patterns adjacent to said perimeter wall of sufficient size for placement of at least one information marking.

15. The assembly of claim 11 wherein said lateral protrusions rearwardly-depending from said mounting plate are configured to provide a secure wrap-around fit of said drain line connection member against one of said support shelves.

16. The assembly of claim 11 wherein said drain line connection member has a bottom front edge and a flange forwardly-extending from said bottom front edge, and further wherein said opposed lateral protrusions rearwardly-depending from said mounting plate are configured to provide a secure wrap-around fit of said drain line connection member against one of said support shelves.

17. A method for using the assembly of claim 1 with a condensate collection pan for condensate collecting purposes and to send a signal that stops condensate production when a pre-established threshold level of collected condensate is reached in the pan, said method comprising the steps of:

providing said assembly, a condensate collection pan with a pre-formed drain line opening, a float body and guide shaft, an O-ring, a connection nut with female threads;

securing said float body and guide shaft within said hollow interior of said switch housing member of said assembly;

inserting said drain line connection member of said assembly through said pre-formed drain line opening until said drain line bore is adjacent to said pre-formed drain line opening; placing said O-ring on said drain line connection member in a position close behind said mounting plate; and securely tightening said connection nut over said drain line connection member to provide a watertight seal between said assembly and said pan.

18. The method of claim 17 wherein the order of said steps of securing said float body and guide shaft and inserting said drain line connection member of said assembly through said pre-formed drain line opening may be reversed, and also wherein the order of said steps of inserting said drain line connection member of said assembly through said pre-formed drain line opening and placing said O-ring on said drain line connection member may be reversed.

19. The method of claim 17 wherein said drain line connection member has a distal end, and further comprising the steps of providing a plug and using said plug within said distal end of said drain line connection member said to block condensate flow through said drain line bore when use of said drain line connection member to discharge condensate from said pan is no longer required.

20. A pan for use in providing a drain line opening for transport out of said pan any surplus condensate accumulating in said pan from an associated condensate producing system, said pan comprising:

a central portion with a plurality of risers spaced apart from one another that are configured and adapted for collective support at least in part of a condensate producing system;

a perimeter wall around said central portion and having at least one preformed drain line opening and mounting structure around said at least one preformed drain line opening configured for secure positioning and long-term fixed orientation of a float switch housing member relative to said pan that resists changes over time which could lead to malfunction of a deployable float body within the float switch housing member; and a plurality of strengthening gussets between said central portion and said perimeter wall.

21. The pan of claim 20 further comprising a plurality of resilient grommets in association with said risers and positioned for use between said risers and a condensate producing system supported by said risers.

22. The pan of claim 20 wherein said central portion has an area without said risers adjacent to said perimeter wall of sufficient size for placement of at least one information marking.

23. The pan of claim 20 made from materials selected from a group consisting of polycarbonate, an ABS/polycarbonate blend, an ABS/polycarbonate blend that is impervious to corrosion, materials used for injection molding manufacture, materials used for thermoform construction, UV-resistant materials, non-flammable materials, and impact-resistant materials.

24. The pan of claim 20 wherein said risers, said central portion, said perimeter wall, said mounting structure, and said gussets, each have a nesting configuration adapted for compact transport and storage of said pan.

25. The pan of claim 20 further comprising structure-strengthening features selected from a group consisting of horizontally-extending curved ribs, angled corner configurations, horizontally-extending ridges between adjacent ones of said gussets.

26. The pan of claim 25 wherein said risers, said central portion, said perimeter wall, said mounting structure, said gussets, said horizontally-extending curved ribs, said angled corner configurations, and said horizontally-extending ridges each have a nesting configuration adapted for compact transport and storage of said pan.

27. The pan of claim 25 wherein said at least one mounting structure is configured as a support shelf.

28. The pan of claim 27 wherein said horizontally-extending curved ribs are positioned on said perimeter wall adjacent to said at least one support shelf.

29. The pan of claim 28 further comprising an assembly configured to provide a drain line opening for transport out of said pan any surplus condensate accumulating in said pan from an associated condensate producing system, said assembly comprising a drain line connection member configured with a substantially planar mounting plate adapted for attachment with said at least one support shelf, a drain line bore through the mounting plate, and a drain line connection member rearwardly-depending from the mounting plate.

30. The pan of claim 29 wherein said assembly further comprises a float switch housing member and secure engagement of said assembly mounting plate to said at least one support shelf of said pan securely fixes said float switch housing in orientation relative to said pan and prevents changes in said float switch housing member relative to said pan over time that could lead to malfunction of a deployable float body within said float switch housing member, said float switch housing member containing during use a vertically-deployable float body configured and positioned to rise with rising levels of condensate collected in said pan and sends a signal to shut off the condensate producing system when a pre-established threshold level of collected condensate is reached in said pan.

31. The pan of claim 30 further comprising a rigid connection member secured in fixed orientation between said float switch housing member and said mounting plate.

32. The pan of claim 29 wherein said mounting plate further comprises at least one horizontally-extending corner rib secured between said rearwardly-depending drain line connection member and each of said rearwardly-depending lateral protrusions.

33. The pan of claim 29 wherein said mounting plate has a bottom front edge and a flange forwardly-extending from said bottom front edge.

34. The pan of claim 29 wherein said mounting plate comprises opposed and substantially rearwardly-depending lateral protrusions configured for wrap-around attachment of said mounting plate to said at least one support shelf.

35. The pan of claim 34 wherein said mounting plate further comprises at least one horizontally-extending corner rib secured between said drain line bore and each of said rearwardly-depending lateral protrusions.

36. A pan for use with an assembly configured to provide a drain line opening for transport out of said pan any surplus condensate accumulating in said pan from an associated condensate producing system, the assembly comprising a drain line connection member configured with a substantially planar mounting plate, a drain line bore through the mounting plate, and a drain line connection member rearwardly-depending from the mounting plate, said pan comprising:

a central portion with a plurality of risers spaced apart from one another that are configured and adapted for collective support at least in part of a condensate producing system;

a perimeter wall around said central portion and at least one support shelf with a preformed drain line opening therein, said at least one support shelf being configured and dimensioned for secure engagement of the assembly mounting plate thereto; and a plurality of strengthening gussets between said central portion and said perimeter wall, whereby as a result of said secure engagement said pre-formed drain line opening becomes aligned with the mounting plate drain line bore and the drain line connection member rearwardly-depending from the mounting plate becomes securely engaged with and fixed in orientation relative to said pre-formed drain line opening.

37. The assembly of claim 1 wherein said drain line connection member further comprises a tubular member rearwardly-depending from said mounting plate, said tubular member being in fluid communication with said bore and having a diameter dimension smaller than the pre-formed drain line opening; and said drain line connecting member further comprises attachment means adapted for leak-proof securing of said tubular member adjacent to the pan after said tubular member is inserted through the pre-formed drain line opening so that said mounting plate becomes positioned within the pan and adjacent to it.

38. The assembly of claim 37 wherein connection between said tubular member and said attachment means of said drain line connection member is at least in part a threaded connection.

39. The assembly of claim 37 wherein said attachment means of said drain line connection member comprises at least one o-ring.

40. The assembly of claim 37 wherein said drain line connection member further comprises opposed and substantially rearwardly-depending lateral protrusions.

41. The assembly of claim 40 wherein said drain line connection member further comprises at least one horizontally-extending corner rib secured between said bore plate and each of said rearwardly-depending lateral protrusions.

42. The assembly of claim 37 wherein said drain line connection member further comprises a rigid connection member attaching a liquid-level float switch housing member to said drain line connection member.

43. The assembly of claim 37 wherein said drain line connection member further comprises a bottom front edge and a flange forwardly-extending from said bottom front edge.

44. The assembly of claim 37 wherein said bore of said mounting plate has a bottom portion, and further comprising a dam positioned to block condensate flow through said bottom portion, and where said dam is selected from a group consisting of permanently installed dams and break-out dams that can be readily removed from their manufactured position via hand pressure.

45. The assembly of claim 37 wherein said drain line connection member further comprises male threads behind said mounting plate in close proximity to said mounting plate.

46. The assembly of claim 37 wherein said drain line connection member has a bottom front edge and a flange forwardly-extending from said bottom front edge, and further comprising opposed lateral protrusions rearwardly-depending from said mounting plate.

47. The assembly of claim 37 further comprising a condensate collection pan having mounting structure around a pre-formed drain line opening that is complementary to that of said mounting plate and configured to securely mate with said mounting plate for long-term fixed positioning of a float switch housing member relative to said pan to prevent changes in said float switch housing member relative to said pan over time that could lead to malfunction of a deployable float body within said float switch housing member.

48. The assembly of claim 47 wherein said mounting structure around said preformed drain line opening is configured as a support shelf.

49. The assembly of claim 47 wherein said pan comprises features selected from a group consisting of a central portion with a plurality of risers spaced apart from one another that are configured and adapted for collective support at least in part of a condensate producing system, a perimeter wall around said central portion and having at least one preformed drain line opening and mounting structure around said at least one preformed drain line opening configured for secure positioning and long-term fixed orientation of a float switch housing member relative to said pan that resists changes over time which could lead to malfunction of a deployable float body within the float switch housing member, a plurality of strengthening gussets between said central portion and said perimeter wall, a plurality of resilient grommets in association with said risers and positioned for use between said risers and a condensate producing system supported by said risers, an area in said central portion without said risers adjacent to said perimeter wall of sufficient size for placement of at least one information marking, horizontally-extending curved ribs, angled corner configurations, and horizontally extending ridges between adjacent ones of said gussets.

50. The assembly of claim 49 wherein said mounting structure around said preformed drain line opening is configured as a support shelf.

51. The assembly of claim 49 wherein said risers, said central portion, said perimeter wall, said mounting structure, said gussets, said horizontally-extending curved ribs, said angled corner configurations, and said horizontally-extending ridges each have a nesting configuration adapted for compact transport and storage of said pan.

52. The assembly of claim 47 wherein said pan is made from materials selected from a group consisting of polycarbonate, an ABS/polycarbonate blend, an ABS/polycarbonate blend that is impervious to corrosion, materials used for injection molding manufacture, materials used for thermoform construction, UV-resistant materials, non-flammable materials, and impact-resistant materials.

* * * * *